United States Patent [19]

Walter et al.

[11] Patent Number: 4,785,268

[45] Date of Patent: Nov. 15, 1988

[54] DIELECTRIC WAVEGUIDE DELAY LINE

[75] Inventors: Jeffrey A. Walter, Wilmington; Kailash C. Garg, Newark; Joseph C. Rowan, Wilmington, all of Del.; Robert H. Gibson, Elkton, Md.

[73] Assignee: W. L Gore & Associates, Inc., Newark, Del.

[21] Appl. No.: 79,686

[22] Filed: Jul. 30, 1987

[51] Int. Cl.[4] ..... H01P 9/00; H01P 9/02

[52] U.S. Cl. ..... 333/157; 333/162; 333/243; 333/245; 333/248

[58] Field of Search ..... 333/156, 157, 162, 160, 333/236, 242, 23, 243, 248, 240, 245

[56] References Cited

U.S. PATENT DOCUMENTS 4,310,816 1/1982 Fuller ..... 333/160 X 4,441,091 4/1984 Nishida et al. ..... 333/242

4,463,329 7/1984 Suzuki ..... 333/239

4,525,693 6/1985 Suzuki et al. ..... 333/236

*Primary Examiner*—Marvin L. Nussbaum

*Attorney, Agent, or Firm*—Mortenson & Uebler

[57] ABSTRACT

A delay line is provided for effecting a desired delay in the transmission of electromagnetic waves in the microwave and millimeter range of the spectrum. The line comprises a length L of a dielectric waveguide for transmission of electromagnetic waves comprising a core of polytetrafluoroethylene having one or more layers of polytetrafluoroethylene overwrapped around the core, wherein $T=KL/c$, in which T is the total time delay , c is the velocity of light in free space and K is the delay constant of the dielectric waveguide. Preferably, the delay line is overwrapped around a mandrel.

14 Claims, 1 Drawing Sheet

DIELECTRIC WAVEGUIDE DELAY LINE

BACKGROUND OF THE INVENTION

This invention relates to delay lines for effecting desired time delays in the transmission of electromagnetic waves.

Transmission lines used to obtain pulse time delays are one class of structure known as delay lines. The line must be rather long even for small time delays since the electromagnetic waves propagate at a speed close to the speed of light. Special compact low-velocity lines have been developed to avoid this inconvenience. The most common type is a coaxial line, in which the inner conductor is a helix. The vast majority of the so-called "electric" delay lines are artificial transmission lines consisting of lumped capacitors and inductors. The limitations of physically realizable amplitude- and phase-transfer functions are such that the practical delays obtained do not exceed the order of a few pulse periods. Longer time delays are achieved with acoustic delay lines, employing acoustic wave propagation and electromechanical transducers at the input and output. See, for example, *Electronic Engineers' Handbook,* Donald G. Fink (ed.), 2d Edition, McGraw-Hill, (1982); and *Introduction to Microwaves,* Gershon J. Wheeler, Prentice-Hall, (1963).

Though very small, flexible and compact, a coaxial cable delay line can have problems at high frequencies in that it exhibits very high insertion loss. The actual amounts of delay required usually involve very long lengths of cable. Generation of power at these frequencies is extremely expensive and, therefore, this is an important factor.

Conventional metal waveguide delay lines are rigid copper tubes which are difficult to package and pose numerous installation problems. A problem with this type of delay line is that of dispersion. Dispersion is the phenomenon wherein different frequencies travel with different velocities. This type of delay line can provide a situation whereby, over a band of frequencies, there will be radically different values for the absolute delay.

Down-convertors with surface acoustic wave delay lines involve down-converting the micro/millimeter wave signal to a low-frequency acoustic signal which may be delayed using a surface acoustic wave delay line. This line will only work over a narrow band and is thus of limited use.

U.S. Pat. No. 4,463,329 discloses a dielectric waveguide of a shaped article having a core of polytetrafluoroethylene and having one or more layers of expanded, porous polytetrafluoroethylene overwrapped on or around the core.

U.S. Pat. No. 4,603,942 discloses a flexible waveguide for transmitting waves from a sensor mounted on a gimbal which includes a cable comprising an outer flexible sheath and a plurality of flexible polytetrafluoroethylene fibers bundled within the sheath and including a termination flange coupled to at least one end thereof, with the flange including a wedge-shaped plug and a tapered cavity engaging the end of the cable.

SUMMARY OF THE INVENTION

A delay line is provided comprising a length L of a dielectric waveguide for the transmission of electromagnetic waves, the dielectric waveguide having a core of polytetrafluoroethylene (PTFE) and one or more layers of polytetrafluoroethylene (PTFE) overwrapped around the core, wherein $T=KL/c$, in which T is the total time delay, c is the velocity of light in free space and K is the delay constant for the dielectric waveguide. The core may be extruded, unsintered PTFE; extruded, sintered PTFE; expanded, unsintered, porous PTFE; or expanded, sintered, porous PTFE. The layer(s) may be extruded, unsintered PTFE; extruded, sintered PTFE; expanded, unsintered, porous PTFE; or expanded, sintered, porous PTFE. The core and layer(s) may contain a filler.

In a preferred embodiment, the delay line is overwrapped over a mandrel, and may be overwrapped in a multiplicity of wraps.

The delay line may have an electromagnetic shielding layer which preferably is aluminized Kapton® polyimide tape. The delay line may be overwrapped with a tape of carbon-filled PTFE.

Figure 1:
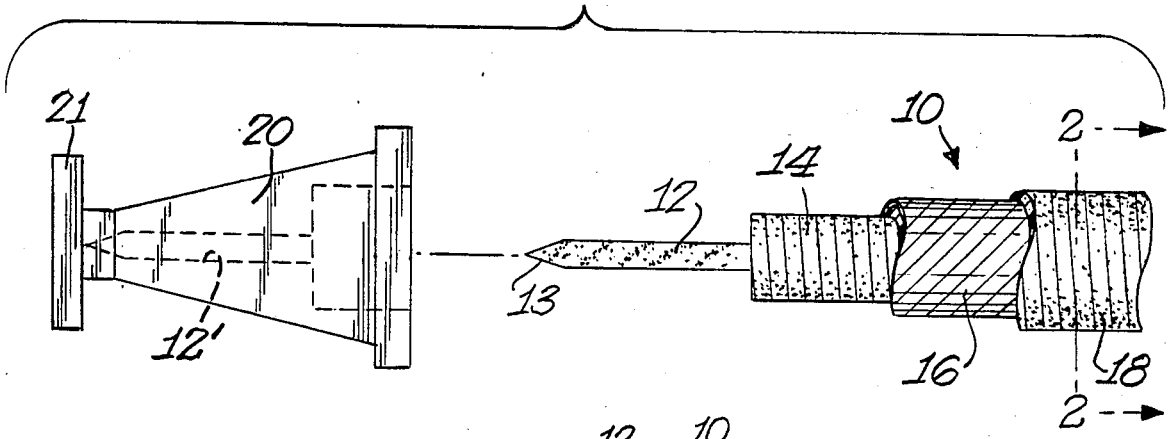
FIG. 1 is a side elevation, with parts of the dielectric waveguide cut away for illustration purposes, of the dielectric waveguide according to the invention and showing one launcher.

DETAILED DESCRIPTION OF THE INVENTION AND PREFERRED EMBODIMENTS WITH REFERENCE TO THE DRAWINGS

A delay line is provided for effecting a desired delay in the transmission of electromagnetic waves in the microwave and millimeter range of the spectrum. The line comprises a length L of a dielectric waveguide for transmission of electromagnetic waves comprising a core of polytetrafluoroethylene having one or more layers of polytetrafluoroethylene overwrapped around the core, wherein $T=KL/c$, in which T is the total time delay, c is the velocity of light in free space and K is the delay constant of the dielectric waveguide. Preferably, the delay line is overwrapped around mandrel.

A detailed description of the invention and preferred embodiments is best provided with reference to the accompanying drawings of the dielectric waveguide of the invention with parts of the dielectric waveguide cut away for illustration purposes. When launcher 20 with conventional flange 21 is connected to dielectric waveguide 10 within seat 12' indicated by the dashed lines, electromagnetic energy enters the launcher 20. An impedance transformation is carried out in the taper 13 of waveguide 10 such that the energy is coupled efficiently into the core 12 of dielectric waveguide 10. Once captured by the core 12, propagation takes place through the core 12 which is surrounded by cladding 14. The core 12 is polytetrafluoroethylene and the cladding 14 is polytetrafluoroethylene, preferably expanded, porous polytetrafluoroethylene tape overwrapped over core 12. Propagation uses the core/cladding interface to harness the energy. Unlike conventional waveguides, the loss mechanism is due to the loss-tangent of the core material and not to surface currents induced on the waveguide walls. The core material also serves to delay the signal by an amount proportional to its dielectric constant.

To prevent cross-coupling or interference from external sources, an electromagnetic shield 16 is provided as well as an external absorber 18. The shield is preferably aluminized Kapton® polyimide tape, and the absorber is preferably carbon-loaded PTFE tape.

Figure 2:
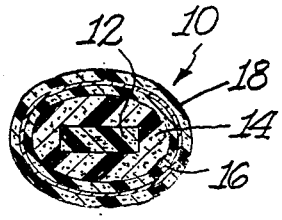
FIG. 2 is a cross-sectional view of the dielectric waveguide of the invention taken along the line 2—2 of FIG. 1.

FIG. 2 is a cross-sectional view of dielectric waveguide 10 taken along line 2—2 of FIG. 1 showing rectangular core 12 overwrapped with tape 14 and showing shield layer 16 and absorber layer 18.

Figure 3:
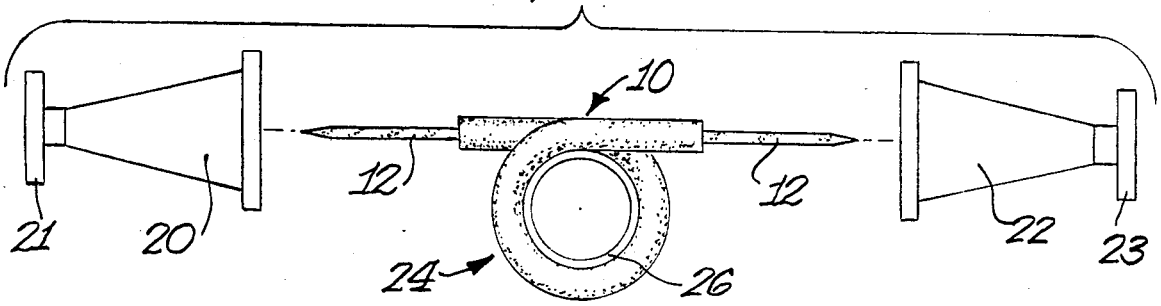
FIG. 3 is a side elevation of the delay line of the invention and coupling launchers at either end of the line.

FIG. 3 shows an elevational view of the dielectric waveguide 10 of the invention wound about mandrel 26, the combination designated 24, and input and output launching horns 20 and 22, respectively, having conventional flanges 21 and 23. By winding dielectric waveguide 10 around mandrel 26, an appropriate amount of cable length is provided to provide a given time delay. This length L may be calculated from knowledge that the unit delay, t, is given by $$t=K/c$$

wherein c is the velocity of light in free space and K is the delay constant for the material used. For PTFE, K is approximately 1.45. For a total required time delay T, it follows that the required length of cable is L, wherein $$L=Tc/K$$

At the output end of the delay line, the other launching horn 22 converts the electromagnetic energy back into its initial field distribution. Attachment to external circuitry is achieved through the standard flanges 21 and 23.

Figure 4:
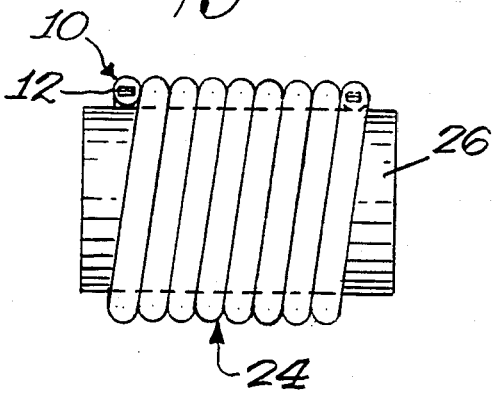
FIG. 4 is a front elevation of the delay line of the invention wrapped about a mandrel.

FIG. 4 is a front elevational view of the combination delay line and mandrel 24 showing dielectric waveguide 10 helically wrapped around mandrel 26. The mandrel may be of any suitable material and preferably is a plastic tube of an acrylic plastic.

Figure 5:
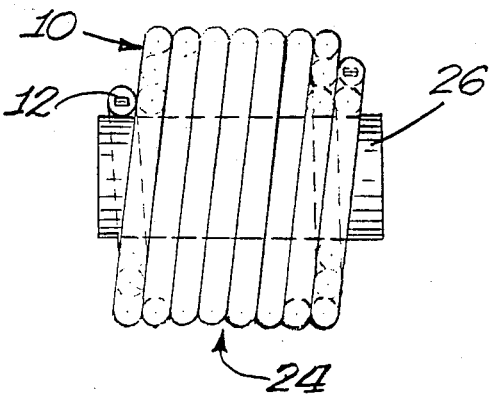
FIG. 5 is a front elevation of the delay line of the invention wrapped about a mandrel in multiple wraps.

FIG. 5 shows a front elevation of the combination delay-line-and-mandrel 24 showing dielectric waveguide 10 wrapped around mandrel 26 in a multiplicity of wraps.

While the invention has been disclosed in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A delay line comprising a length L of a dielectric waveguide for the transmission of electromagnetic waves, said dielectric waveguide having:

(a) a core of polytetrafluoroethylene (PTFE);

(b) one or more layers of polytetrafluoroethylene (PTFE) overwrapped around said core, wherein $$T=KL/c,$$

in which T is the total time delay, c is the velocity of light in free space and K is the delay constant for said dielectric waveguide;

(c) said one or more layers of polytetrafluoroethylene (PTFE) having an electromagnetic shielding layer thereover; and (d) said shielding layer being further overwrapped with a tape of carbon-filled PTFE.

2. The delay line of claim 1 wherein said core is extruded, unsintered PTFE.

3. The delay line of claim 1 wherein said core is extruded, sintered PTFE.

4. The delay line of claim 1 wherein said core is expanded, unsintered, porous PTFE.

5. The delay line of claim 1 wherein said core is expanded, sintered, porous PTFE.

6. The delay line of claim 1 wherein said core contains a filler.

7. The delay line of claim 1 wherein said layer(s) is extruded, unsintered PTFE.

8. The delay line of claim 1 wherein said layer(s) is extruded, sintered PTFE.

9. The delay line of claim 1 wherein said layer(s) is expanded, unsintered, porous PTFE.

10. The delay line of claim 1 wherein said layer(s) is expanded, sintered, porous PTFE.

11. The delay line of claim 1 wherein said layer(s) contains a filler.

12. The delay line of claim 1 overwrapped over a mandrel.

13. The delay line of claim 12 overwrapped over a mandrel in a multiplicity of wraps.

14. The delay line of claim 1, wherein said shielding layer is aluminized Kapton® polyimide tape.

* * * * *